United States Patent [19]

Candelaria, Jr.

[11] Patent Number: 5,033,583

[45] Date of Patent: Jul. 23, 1991

[54] CHAIN LINK FENCE LADDER APPARATUS

[76] Inventor: John Candelaria, Jr., 32356 Kentucky St., Yucaipa, Calif. 92399

[21] Appl. No.: 550,059

[22] Filed: Jul. 9, 1990

[51] Int. Cl.[5] ..... E06C 1/38; E06C 7/50; E06C 7/08; E06C 1/36

[52] U.S. Cl. ..... 182/92; 182/100; 182/189; 182/228

[58] Field of Search ..... 182/92, 100, 189, 228

[56] References Cited

U.S. PATENT DOCUMENTS

| | | | |
|---|---|---|---|
| 197,766 | 12/1877 | Crawford | 182/189 |
| 480,977 | 8/1892 | Thomas | 182/189 |
| 3,817,351 | 6/1974 | Mikkelson | 182/189 |
| 4,249,635 | 2/1981 | West | 182/92 |
| 4,265,333 | 5/1981 | Rowell | 182/92 |
| 4,388,983 | 6/1983 | Bartels | 182/92 |
| 4,754,841 | 7/1988 | Koffski | 182/92 |
| 4,830,142 | 5/1989 | McManus | 182/92 |

*Primary Examiner*—Reinaldo P. Machado
*Attorney, Agent, or Firm*—Leon Gilden

[57] ABSTRACT

An apparatus including a planar support member including a forward and rear face; each face aligned parallel to one another with a through extending diamond shaped rod directed orthogonally through the forward and rear faces, with a square groove formed in the rod adjacent the rear face to receive a chain link grid member therein. An enclosing safety chain is positioned in surrounding relationship relative to the adjacent chain link fence and an upper rod of the rod members. A modification of the invention includes a step plate defined by a diamond shaped socket and a planar step member aligned with the socket securable to the rod members.

6 Claims, 4 Drawing Sheets

PRIOR ART 17
19
35
12
15
18
35
23
20

CHAIN LINK FENCE LADDER APPARATUS

BACKGROUND OF THE INVENTION

1. Field of the Invention

The field of the invention relates to ladder structures, and more particularly pertains to a new and improved chain link fence ladder apparatus wherein the same is readily and securably mounted within a chain link fence grid.

2. Description of the Prior Art

Ladder structures of various types are available in the prior art and the prior art has heretofore attempted to address a need for ease of access to climb a chain link fence with a ladder arrangement, but has heretofore failed to set forth a readily mounted chain link ladder structure as presented by the instant invention. Chain link fences by their configuration are difficult to transverse typically due to the small mesh size and various center to center dimension defined by the chain link grid sizes defining their construction. An example of prior art fence climbing structure may be found in U.S. Pat. No. 4,249,635 to West setting forth a fence climber for use with chain link type structures wherein a generally "V" shaped bracket including outwardly directed legs is positional through a chain link mesh, wherein a series of such members are mounted to the fence to permit climbing of the fence grid network.

U.S. Pat. No. 4,830,142 to McManus sets forth a barbed wire type fence ladder wherein the organization is securable to a post of an associated barbed wire fence network, wherein the post includes steps to permit access over the barbed wire fencing.

U.S. Pat. No. 4,388,983 to Bartels, et al. provides a lightweight type ladder including a generally flat tubing with rungs mounted thereon with clips for securement of the ladder structure to an associated post such as utilized in electrical transmission lines.

U.S. Pat. No. 4,754,841 to Koffski provides leg members positionable upon a post to permit securement of the leg members for conversion of the post to a ladder structure.

U.S. Pat. No. 4,265,333 to Rowell, et al. wherein a barbed wire fence stile utilizes a generally "U" shaped bracket to overlie a barbed wire fence post with foot members mounted on opposing legs of the "U" shaped bracket to provide a ladder structure overlying the fence organization.

As such, it may be appreciated that there continues to be a need for a new and improved chain link fence ladder apparatus as set forth by the instant invention that addresses both the problems of ease of use as well as effectiveness in construction in securement to a chain link fence grid to permit swift access over a fence and security once locked in position unattended periods or hooks for short periods and in this respect, the present invention efficiently fulfills many needs.

SUMMARY OF THE INVENTION

In view of the foregoing disadvantages inherent in the known types of ladder apparatus now present in the prior art, the present invention provides a chain link fence ladder apparatus wherein the same is readily stored during periods of non-use and is readily and easily mounted to a chain link fence to permit swift and safe two-way ease of climbing mobility access over the fence. As such, the general purpose of the present invention, which will be described subsequently in greater detail is to provide a new and improved chain link fence ladder apparatus which has all the advantages of the prior art ladder apparatus and none of the disadvantages.

To attain this, the present invention provides apparatus including a planar support member including a forward and rear face; each face aligned parallel to one another with a through extending diamond shaped rod directed orthogonally through the forward and rear faces with a notch formed in the rod adjacent the rear face to receive a chain link grid member therein. An enclosing safety chain is positioned in surrounding relationship relative to the adjacent chain link fence and an upper rod of the rod members. A modification of the invention includes a step plate defined by a diamond shaped socket and a planar step member aligned with the socket securable to the rod members.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, accessories, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quick]y from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chain link fence ladder apparatus which has all the advantages of the prior art link fence ladder apparatus and none of the disadvantages.

It is another object of the present invention to provide a new and improved chain link fence ladder apparatus which may be easily and efficiently manufactured and marketed.

It is a further object of the present invention to provide a new and improved chain link fence ladder apparatus which is of a durable and reliable construction.

An even further object of the present invention is to provide a new and improved chain link fence ladder apparatus which is susceptible of a low cost of manufacture with regard to both materials and labor, and which accordingly is then susceptible of low prices of sale to the consuming public, thereby making such chain link fence ladder apparatus economically available to the buying public.

Still yet another object of the present invention is to provide a new and improved chain link fence ladder apparatus which provides in the apparatuses and methods of the prior art many of the advantages thereof, while simultaneously overcoming many of the disadvantages normally associated therewith.

Still another object of the present invention is to provide a new and improved chain link fence ladder apparatus which may be compactly stored when not being utilized.

yet another object of the present invention is to provide a new and improved chain link fence ladder apparatus wherein the same is readily mounted to a chain link fence to provide a stable and secure ladder organization in association with the fence.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
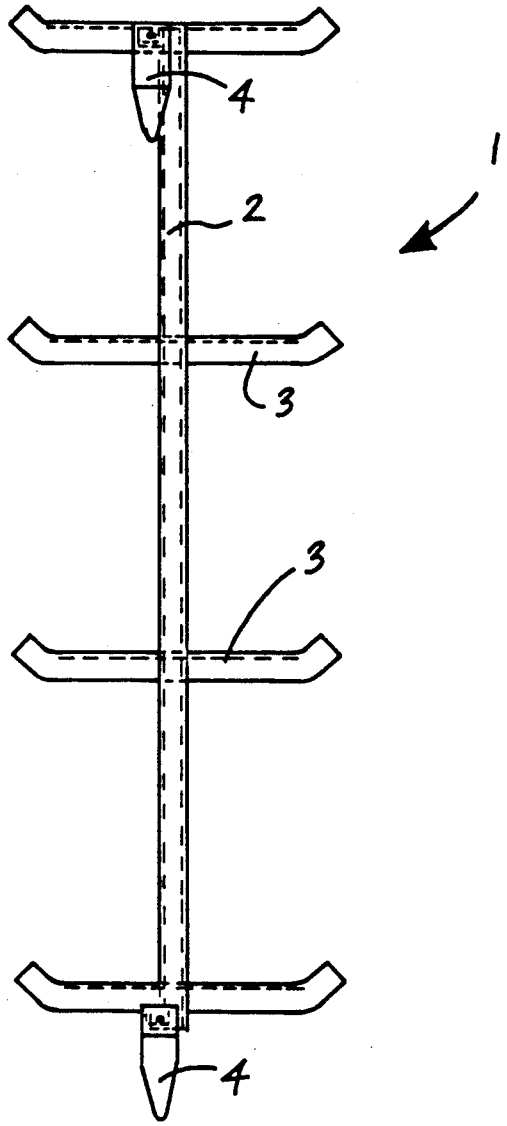
FIG. 1 is an orthographic view, taken in elevation, of a prior art fence ladder apparatus.

With reference now to the drawings, and in particular to FIGS. 1 to 8 thereof, a new and improved chain link fence ladder apparatus embodying the principles and concepts of the present invention and generally designated by the reference numeral 10 will be described.

Figure 2:
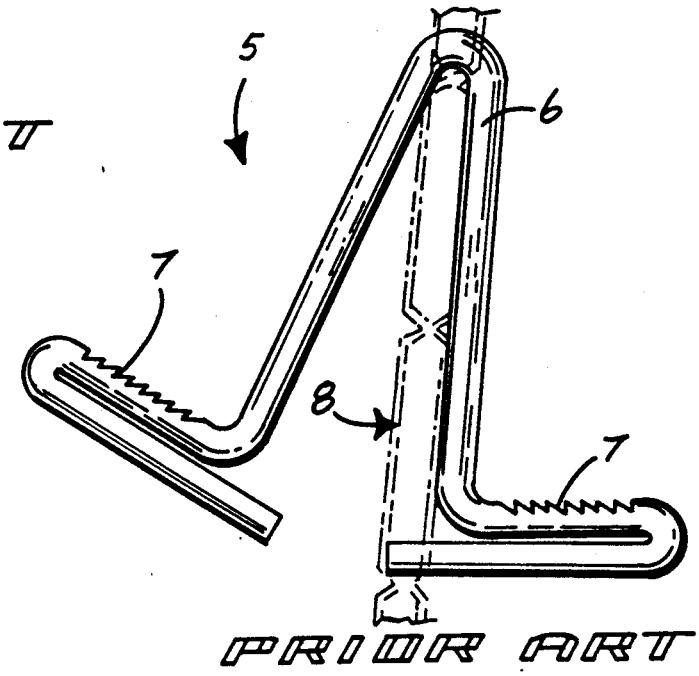
PRIOR ART Fig 2
FIG. 2 is an orthographic side view, taken in elevation, of a prior art chain link fence ladder-type apparatus.
Figure 3:
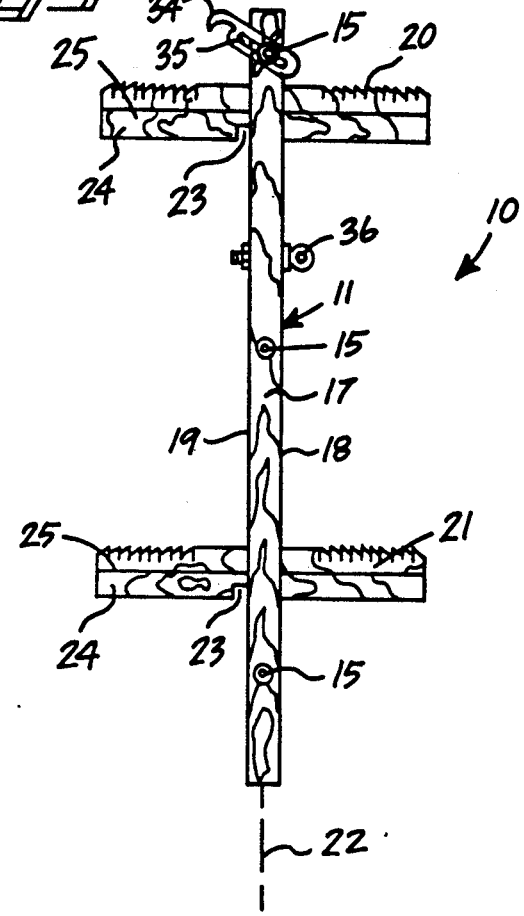
FIG. 3 is an orthographic side view, taken in elevation, of the instant invention.
Figure 3A:
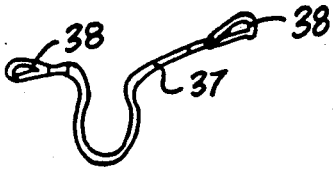
FIG. 3*a* is an orthographic side view, taken in elevation, of a security strap utilized by the instant invention.

FIG. 1 is illustrative of a prior art ladder structure 1 for securement to utility type post members 9, wherein the apparatus 1 includes an elongate spine 2 including a series of tread members 3 mounted orthogonally thereacross, with overlying clip portions 4 for securement to the aforenoted post structure. FIG. 2 illustrates a prior art chain link fence ladder type apparatus 5, wherein a generally "V" shaped bracket 6 includes serrated legs 7 extending outwardly of the "V" shaped bracket for positioning of an apex of the "V" shaped bracket through a chain link fence structure 8 formed of conventional open mesh woven wire into a grid of generally diamond shaped cells. Such fence structure is typically utilized and illustrated in FIG. 6 for example.

More specifically, the chain link fence ladder apparatus 10 of the instant invention essentially comprises an elongate longitudinally aligned support 11 defined by a longitudinal axis 22 with a first, second, and third reinforcing bolt 12, 13 and 14 directed at equally spaced intervals through opposed side walls of the support 11. The side walls are illustrated as a first side wall 16 and a second side wall 17 spaced relative to and parallel one another with a threaded fastener 15 secured to a projecting free terminal end of each of the reinforcing bolts. Each of the reinforcing bolts is provided with a through extending shank directed through the support 11 to minimize splitting and separating of the organization in use (see FIG. 5 for example). Reinforcing bolts would be necessary for wooden models, but would not be required for aluminum, plastics, fiberglass, and other models formed of high tensible strength.

The support 11 includes a forward planar wall 19 spaced from and coextensively parallel to a rear planar wall 18. A top and bottom through extending rod member 20 and 21 respectively are orthogonally directed orthogonally through the forward and rear planar walls 18 and 19 extending forwardly of each of the walls. Each of the rods are defined by a triangular shaped cross-sectional configuration defined by a planar ribbed top surface. In a typical fence climbing environment, the support 11 is generally of a length within twenty-four inches to forty-eight inches long and wherein the bottom rod member 21 is spaced from a lower terminal edge of the support approximately four to twelve inches, while the top rod member 20 is positioned below a top terminal end of the support approximately two to ten inches The rod members 20 and 21 are aligned with the longitudinal axis 22 of the support 11 and each are defined by a rod axis 25. A square groove 23 is directed into each side of the bottom half of the rods 20 and 21 originating at a bottom apex 24 of each of the diamond shaped configurations extending upwardly therefrom positioned substantially aligned with the rod axis 25 of each rod member 20 and 21. The square grooves 23 are arranged to receive a bottom apex intersection of wires defining each diamond shaped cell of the fence structure 8, wherein it is noted that each opening of the diamond shaped cell is of a configuration to receive each rod member 20 and 21 in a complementary relationship therethrough and wherein the rod members 20 and 21 and their associated axis 25 are spaced apart a predetermined distance substantially equal to a predetermined distance defined between spacing between a multiple of such aforenoted cells of the fence structure 8. Further, a flexible securement strap 37 is provided and formed with safety hook members 38 formed at terminal ends thereof for surrounding securement of the support 11, while woven through an associated fence structure 8 (see FIG. 6) to secure the support to the fence structure. The hook members 38 are secured to the eye bolt fastener 36 to securedly mount the apparatus to the fence structure. At least one, and preferably a plurality, of hook members 34 are mounted to the fastener 15 to each side of the support, including the first and second side walls 16 and 17. The hook fasteners each include an elongate body defining an enclosed hook slot 35 mounted therewithin, wherein the hook slot 35 slidably and adjustably positions the associated hook structure relative to the fastener 15 and the associated support 11, as illustrated, to permit securement of the hooks to the fence structure for additional safety during use.

Figure 4:
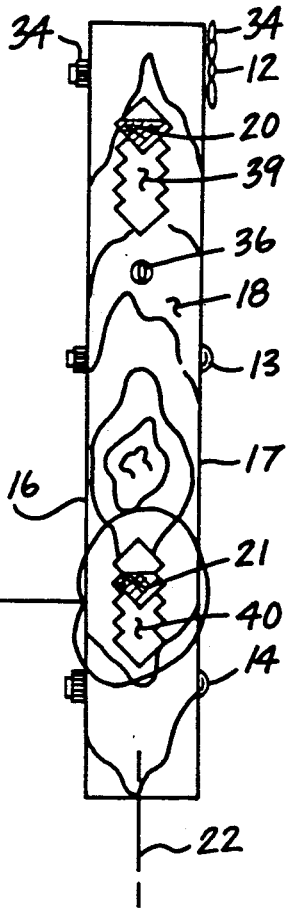
FIG. 4 is an orthographic frontal view, taken in elevation, of the instant invention.
Figure 4A:
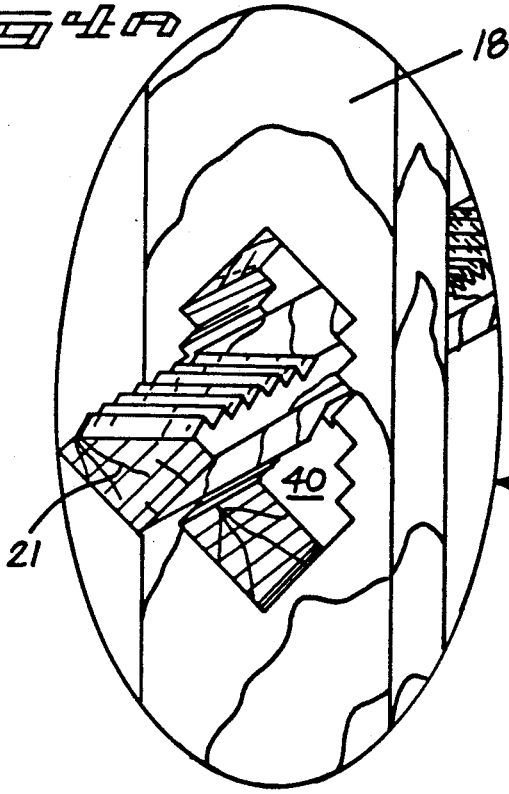
FIG. 4*a* is an isometric illustration, somewhat enlarged, of section 4*a* as set forth in FIG. 4.
Figure 5:
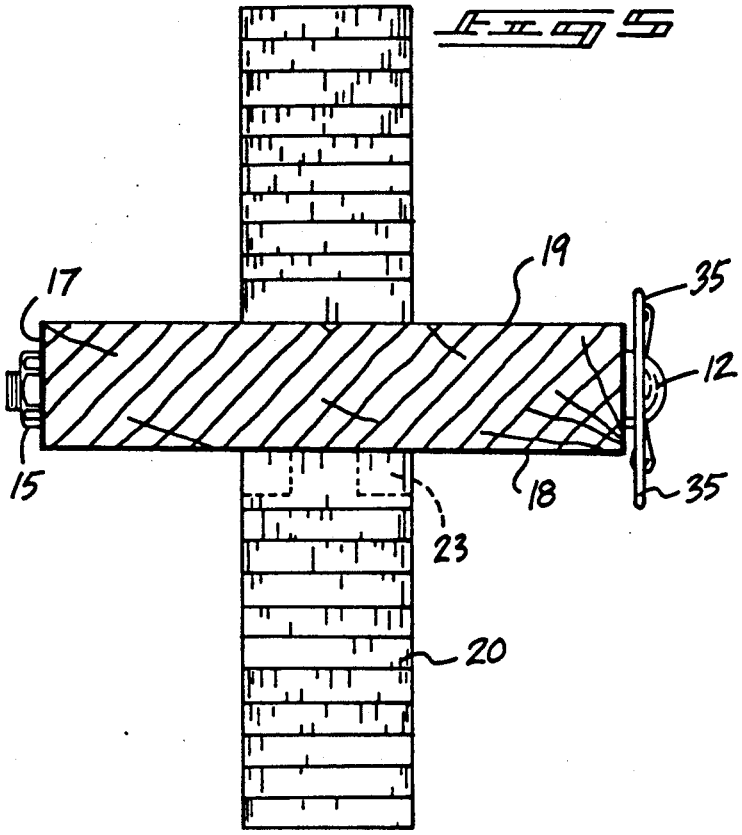
FIG. 5 is an orthographic top view of the instant invention.
Figure 6:
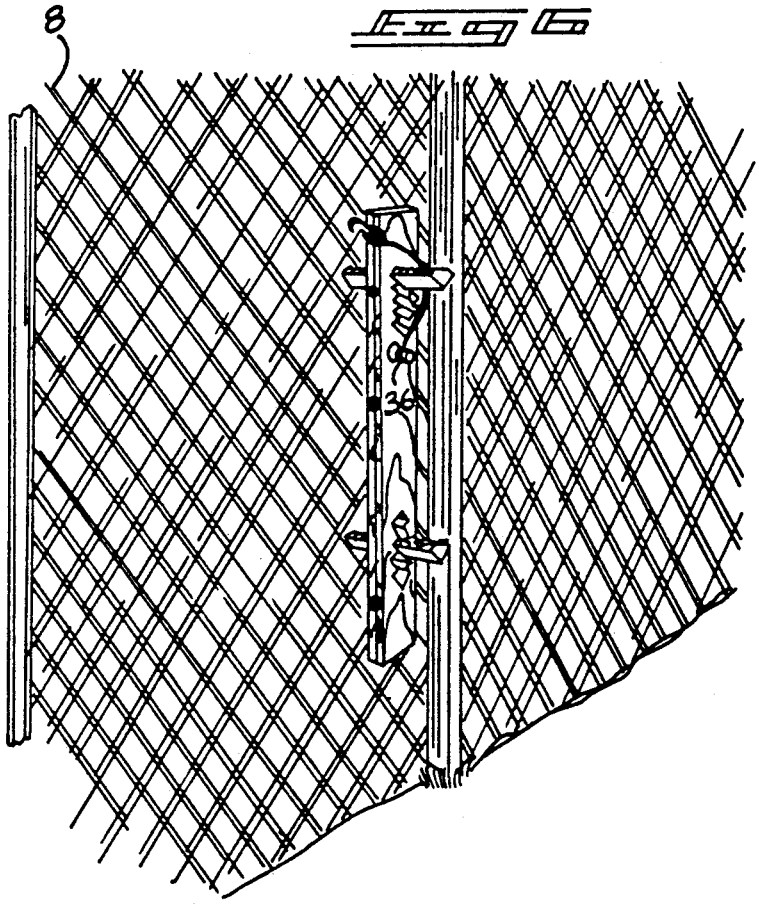
FIG. 6 is an isometric illustration of the instant invention mounted to a chain link fence structure.

FIGS. 4 and 5 illustrate the use of the top and bottom rod members 20 and 21 (each formed with a non-slip serrated top surface and of a generally triangular cross-sectional configuration) mounted within an associated top and bottom enclosed slot 39 and 40. Each of the slots include opposed parallel ribbed side walls, wherein the ribbed side walls define aligned recesses to complementarily receive opposed apex edges of the triangular cross-sectional configuration top and bottom rods, in a manner as illustrated in FIGS. 4 and 4*a* for example, to permit vertical adjustment of each of the rods within the aligned support 11 effecting spaced step adjustment of the rods within the support structure, in a manner as illustrated. Further, it is contemplated that the rods 20 and 21 may further include extensible sleeves mounted to the rods to permit extension of the rods in use and effectively provide enhanced area to accommodate an individual thereon.

Figure 7:
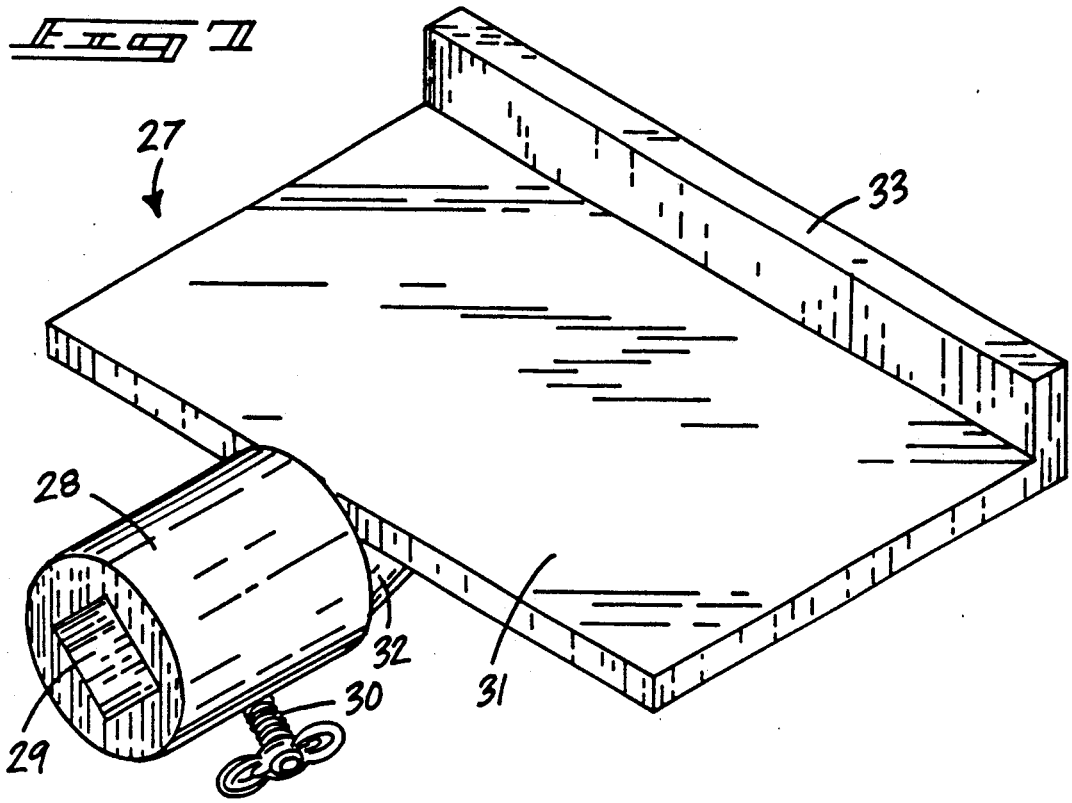
FIG. 7 is an isometric illustration of an extension step utilized in conjunction with the instant invention.
Figure 8:
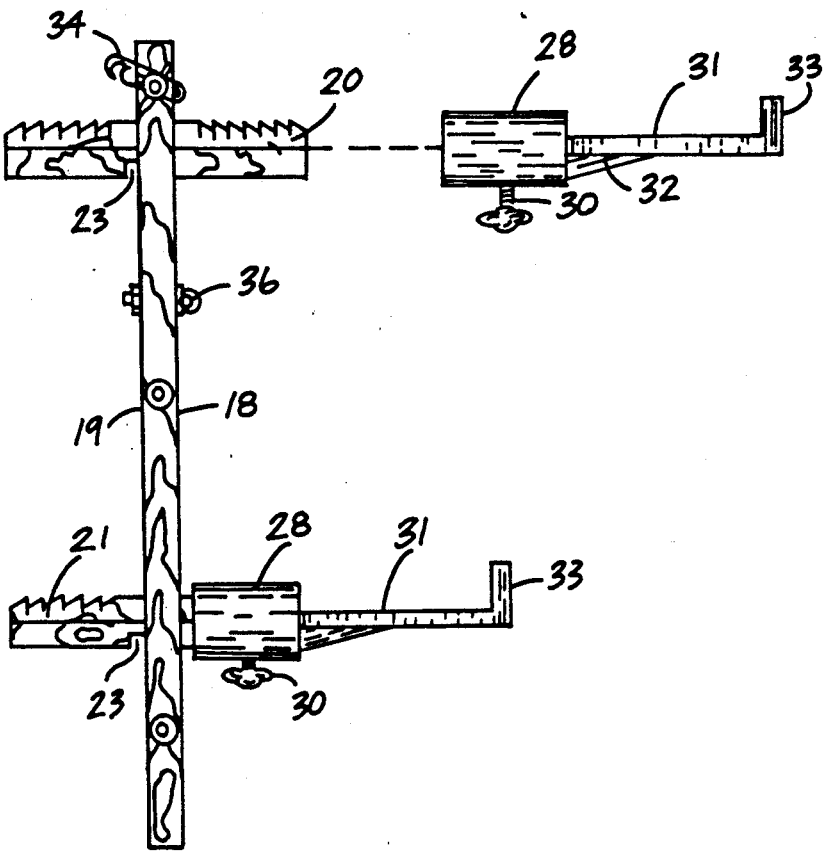
FIG. 8 is an orthographic side view, taken in elevation, of the step extension in association with a ladder apparatus of the instant invention.

Reference to FIGS. 7 and 8 illustrate the use of the rod extension steps 27 incorporated by the instant invention to enhance surface area available to individual stepping upon the rod members 20 and 21 for use as steps in the ladder organization. The extension step 27 is defined by an axially aligned socket 28 including a diamond shaped cavity 29, wherein side apex portions of the diamond shaped cavity 29 are in substantial alignment with a planar step plate 31 that extends forwardly of the socket 28 and includes a gusset 32 fixedly mounted between the bottom surface of the step 31 and the socket 28. A lip 33 is integrally mounted and formed to a forward longitudinal end of the step 31 to further enhance security of an individual's foot positioned on the surface of the step plate 31. The socket 28 further includes a locking bolt 30 orthogonally and threadedly mounted through a side wall of each socket entering the diamond shaped cavity 29 to engage and lock a respective rod member 20 and 21 therewithin, as illustrated in FIG. 8 for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder apparatus for use with a chain link fence, the chain link fence defined by interwoven fabric mesh defined by diamond shaped cells, each diamond shaped cell defined by a predetermined configuration, the apparatus comprising, a longitudinally aligned support, the support including a planar forward wall spaced from and parallel to a planar rear wall, the planar forward wall and planar rear wall aligned coextensively relative to one another, and first and second side walls orthogonally arranged between opposed side edges of the forward and rear planar walls, and a top rod member and a bottom rod member orthogonally directed through the support and orthogonally arranged through the planar forward wall and planar rear wall extending outwardly therefrom, and the top member spaced adjacent a top edge of the support and the bottom rod member positioned adjacent a bottom edge of the support, and wherein each rod member is defined by a triangular shaped cross-sectional configuration and a ribbed planar top surface, and the support includes a longitudinal axis arranged medially of the support end of thee forward and rear walls, and each rod member orthogonally aligned with the longitudinal axis of the support, and each rod member defined by a rod member axis, and wherein each rod member includes a square groove, the square groove extending from a lower inner section of the triangular shaped configuration adjacent the rear planar wall and upwardly substantially in alignment with the rod axis.

2. An apparatus as set forth in claim 1 including a plurality of reinforcing fasteners directed orthogonally through the side walls of the support and securing the side walls together to minimize splintering and fracturing of the support during use.

3. An apparatus as set forth in claim 2 further including an elongate flexible securement strap positioned in surrounding relationship underlying the top rod member and extending through the chain link fence in surrounding relationship to the support and adjacent cells of the chain link fence.

4. An apparatus as set forth in claim 3 further including a rod extension step, the rod extension step including a planar support member, the planar support member orthogonally arranged relative to an elongate socket, the elongate socket integrally mounted to a rear edge of the planar plate, the elongate socket further including a diamond shaped cavity, the diamond shaped cavity including laterally opposed apex sections, the intersections substantially in alignment with the plate, and an elongate lip integrally and orthogonally mounted to a forward edge of the plate extending upwardly therefrom.

5. An apparatus as set forth in claim 4 wherein the socket further includes a threaded locking bolt directed orthogonally through the socket and in communication with the diamond shaped cavity to engage and lock a rod member therewithin.

6. An apparatus as set forth in claim 5 wherein each rod member is defined by a predetermined width, and the support includes an elongate top slot and an elongate bottom slot receiving a respective top and bottom rod member, each top slot and bottom slot includes ribbed parallel side walls, therein opposing recesses of each ribbed side wall is substantially equal to a predetermined spacing substantially equal to the predetermined width of each rod member.

* * * * *